US006390646B1

(12) United States Patent
Yan

(10) Patent No.: US 6,390,646 B1
(45) Date of Patent: May 21, 2002

(54) FLUORESCENT TABLE LAMP HAVING A MODULAR SUPPORT ADAPTER USING A REPLACEABLE ELECTRONIC BALLAST

(75) Inventor: Ellis Yan, South Russell, OH (US)

(73) Assignee: Technical Consumer Products, Inc., Aurora, OH (US)

( * ) Notice: Subject to any disclaimer, the term of this patent is extended or adjusted under 35 U.S.C. 154(b) by 0 days.

(21) Appl. No.: 09/478,416

(22) Filed: Jan. 6, 2000

Related U.S. Application Data

(63) Continuation-in-part of application No. 09/466,028, filed on Dec. 20, 1999, which is a continuation-in-part of application No. 09/434,555, filed on Nov. 8, 1999.

(51) Int. Cl.[7] ..... F21S 5/00

(52) U.S. Cl. ..... 362/260; 362/216; 362/431; 362/414; 439/236

(58) Field of Search ..... 362/216, 431, 362/410, 414, 260, 417, 411; 439/236; 315/58, 5 L; 318/318.01, 318.05, 318.09, 318.12, 634

(56) References Cited

U.S. PATENT DOCUMENTS

| | | | | |
|---|---|---|---|---|
| 3,742,208 A | | 6/1973 | Mills | |
| 3,953,761 A | * | 4/1976 | Giudice | 315/51 |
| 4,414,489 A | * | 11/1983 | Young | 315/51 |
| 4,956,756 A | | 9/1990 | Hsiao | |
| 5,065,292 A | * | 11/1991 | Aubrey | 362/260 |
| 5,128,590 A | | 7/1992 | Holzer | |
| 5,149,149 A | | 9/1992 | Wu | |
| 5,324,213 A | | 6/1994 | Frantz | |
| 5,424,610 A | * | 6/1995 | Pelton et al. | 362/417 |
| 5,580,161 A | | 12/1996 | Vakil | |
| 5,585,688 A | * | 12/1996 | DeKleine | 313/318.01 |
| 5,700,154 A | * | 12/1997 | Geary | 439/236 |
| 5,938,316 A | * | 8/1999 | Yan | 362/260 |
| 6,083,021 A | * | 7/2000 | Lau | 439/227 |
| 6,124,673 A | * | 9/2000 | Bishop | 315/56 |

* cited by examiner

*Primary Examiner*—Thomas M. Sember
(74) *Attorney, Agent, or Firm*—Joseph H. Taddeo

(57) ABSTRACT

The present invention relates primarily to a modular replaceable ballast as used in a table or floor lamp using a circular fluorescent lamp as the primary source of illumination. Circular fluorescent lamps have been in use for many years to provide superior operating and lighting efficiency. These lamps can provide many years of trouble free performance, obviating the need for frequent replacement that is needed by comparable wattage incandescent bulbs. The ballasts, on the other hand, have not enjoyed the same degree of success of having similar reduced failure rates. The present invention utilizes a plug-in replaceable electronic ballast which can easily be replaced by a novice person. Because this ballast is plugged into a compatible adapter receptacle, the need for dismantling or disassembling the fixture is thereby obviated. The plug-in electronic ballast has two centrally located pins that insert into the newly designed modular receptacle. Two locking tabs engage with compatible recesses in the receptacle to secure the electronic ballast to the adapter receptacle, where the ballast pins mate with the female receptacles in the modular adapter. The modular adapter housing is sufficiently large enough to suitably house a rotary switch for turning the lamp either on or off, or to house wired connections spliced to the lamp cord. A plug fitting converts the adapter housing to a remotely switched table or floor lamp by covering the switch operator opening. Two interchangeable adapter bases are provided; the first having a boss with female ⅛ inch pipe threaded opening, the second having a male threaded ⅛ inch pipe nipple. A newly designed integral strain relief system captures and retains the lamp cord to prevent an electrical failure. Two sets of tines separate, captivate and secure each of the power lines of the lamp cord.

17 Claims, 8 Drawing Sheets

FLUORESCENT TABLE LAMP HAVING A MODULAR SUPPORT ADAPTER USING A REPLACEABLE ELECTRONIC BALLAST

REFERENCE TO PREVIOUSLY FILED APPLICATIONS

This application is a continuation-in-part of Application Serial No. 09/466,028, filed Dec. 20, 1999, pending, which is a continuation-in-part of Application Ser. No. 09/434,555, filed Nov. 8, 1999, pending.

FIELD OF THE INVENTION

The present invention relates primarily to a table lamp having a replaceable modular electronic ballast and adapter, and more particularly to a replaceable modular electronic ballast and adapter for use in fluorescent table or floor lamps.

BACKGROUND OF THE INVENTION

Table lamps, using fluorescent lamps are well known in the prior art. Circular fluorescent lamps have been in use for many years to provide superior operating and lighting efficiency. These lamps can provide many years of trouble free performance, obviating the need for frequent replacement as is needed by comparable wattage incandescent bulbs.

The ballasts, on the other hand, have not enjoyed the same degree of success of having similar reduced failure rates. Vintage ballasts that used bulky iron core inductors encountered serious overheating problems that required vents to provide increased air circulation for cooling, thereby reducing the heat dissipation. Overheating became such a serious problem that earlier fixtures introduced thermal protective devices to sense and protect them from the effects of overheating. Newer electronic ballasts were introduced that have reduced heating, but because of the increased number of electronic components and perhaps having over-stressed electronic components, the failure rate is still excessive.

In the event of a failure of one the major wired components in a table of floor lamp lighting fixture, one generally requires the service of a skilled lighting fixture repairman to replace the defective part. A repair of this nature usually requires specialized tools to remove and replace the defective components.

In this regard, the present invention overcomes the objections of the prior art. Examples of such prior art are shown in the examples that follow.

U.S. Pat. No. 5,580,161, granted Dec. 3, 1996, to U. Vakil, et al., discloses a fluorescent light fixture having a fluorescent light starter assembly secured within a vented housing.

U.S. Pat. No. 5,324,513, granted Jun. 28, 1994, to R. H. Frantz, teaches of a ballast connector for use with a fluorescent light fixture, a connector which is used for readily and reliably inserting and extracting discrete wires.

U.S. Pat. No. 5,149,149, granted Sep. 22, 1992, to W. C. Wu, discloses a pipe connecting device for detachably connecting two tubes into a support for use in a floor lamp; the tubular bushings each having a curved groove engaging two unitary pins located on either side of a pipe connector.

U.S. Pat. No. 5,128,590, granted Jul. 7, 1992, to W. Holzer, discloses a compact fluorescent lamp and an electronic ballast that is constructed as a separate unit, which constituting an adapter, is electrically and mechanically connectable with the lamp by means of a plug-in connection. The plug-in connection between the ballast and the lamp extends in the direction of the lamp at least partially into the space surrounded by the lamp to achieve the smallest possible length.

U.S. Pat. No. 4,956,756, granted Sep. 11, 1990, to W. J. Hsiao, teaches of a table lamp adapter for providing interchangeability between incandescent and fluorescent light bulbs. The adapter system is comprised principally of a tubular housing, and a 3-way switch mechanism.

U.S. Pat. No. 3,742,208, granted Jun. 26, 1973, to A. Mills, discloses a lighting fixture that utilizes one or more circular fluorescent lamps that is connectable to conventional screw-in or bayonet type sockets. A pair of upper and lower housing members provides a supporting enclosure for the ballast and starter components. In another embodiment, the fixture is adaptable for use as a table or floor lamp.

The prior art recited above does not teach of the novel advantages that are found in the present invention. To obviate the need for an experienced repairman or the need for specialized tools, the present invention discloses a replaceable electronic ballast that is inserted into a compatible adapter, one that can be easily replaced by a novice user.

Accordingly, it is therefore an object of the present invention to provide a novel fluorescent table lamp having a modular replaceable electronic ballast, where the modular ballast is easily removed and replaced by a novice user, by unplugging the ballast from the ballast adapter.

It is another object of the present invention to provide a novel fluorescent table lamp having a modular replaceable electronic ballast, where the modular ballast is retained by the ballast adapter by two hooked appendages that engagedly lock into the ballast adapter.

It is still another object of the present invention to provide a novel fluorescent table or floor lamp having a modular replaceable electronic ballast, where the modular adapter has the provision for housing an internal power switch.

It is still yet another object of the present invention to provide a novel fluorescent table or floor lamp having a modular replaceable electronic ballast, where the modular adapter has interchangeable components to provide flexibility during the manufacture and assembly process.

An additional object of the present invention is to provide a novel fluorescent table or floor lamp having a modular replaceable electronic ballast, where the modular adapter has newly designed integral strain relief tines to capture and retain a lamp cord to prevent an electrical failure.

A final object of the present invention is to provide a novel fluorescent table or floor lamp having a modular replaceable electronic ballast that is compatible with a circular fluorescent lamp.

These as well as other objects and advantages of the present invention will be better understood and appreciated upon reading the following detailed description of the preferred embodiment when taken in conjunction with the accompanying drawings.

SUMMARY OF THE INVENTION

The present invention relates to a table or floor lamp using a circular fluorescent lamp as the primary source of illumination. These lamps utilize a novel replaceable electronic ballast that is modular in construction, where the ballast is plugged into a compatible adapter receptacle. The need for dismantling or disassembling the fixture is thereby obviated.

The plug-in electronic ballast has two centrally located pins that insert into the newly designed modular receptacle. Two locking tabs engage with compatible recesses in the receptacle to secure the electronic ballast to the adapter receptacle. The ballast pins mate with the female receptacles in the modular adapter.

The modular adapter housing is sufficiently large enough to suitably house a rotary switch for turning the lamp either on or off, or to house wired connections that are spliced to the lamp cord. A plug fitting converts the adapter housing to a remotely switched table or floor lamp by covering the switch operator opening.

There are two interchangeable adapter bases; the first having a boss with female ⅛ inch pipe threaded opening, the second having a male threaded ⅛ inch pipe nipple.

The modular adapter has a newly designed integral strain relief system to capture and retain a lamp cord to prevent an electrical failure. There are two sets of tines to captivate and secure each of the power lines of the lamp cord.

BRIEF DESCRIPTION OF THE DRAWINGS

The present invention is pictorially illustrated in the accompanying drawings that are attached herein.

DETAILED DESCRIPTION OF THE INVENTION

Figure 1:
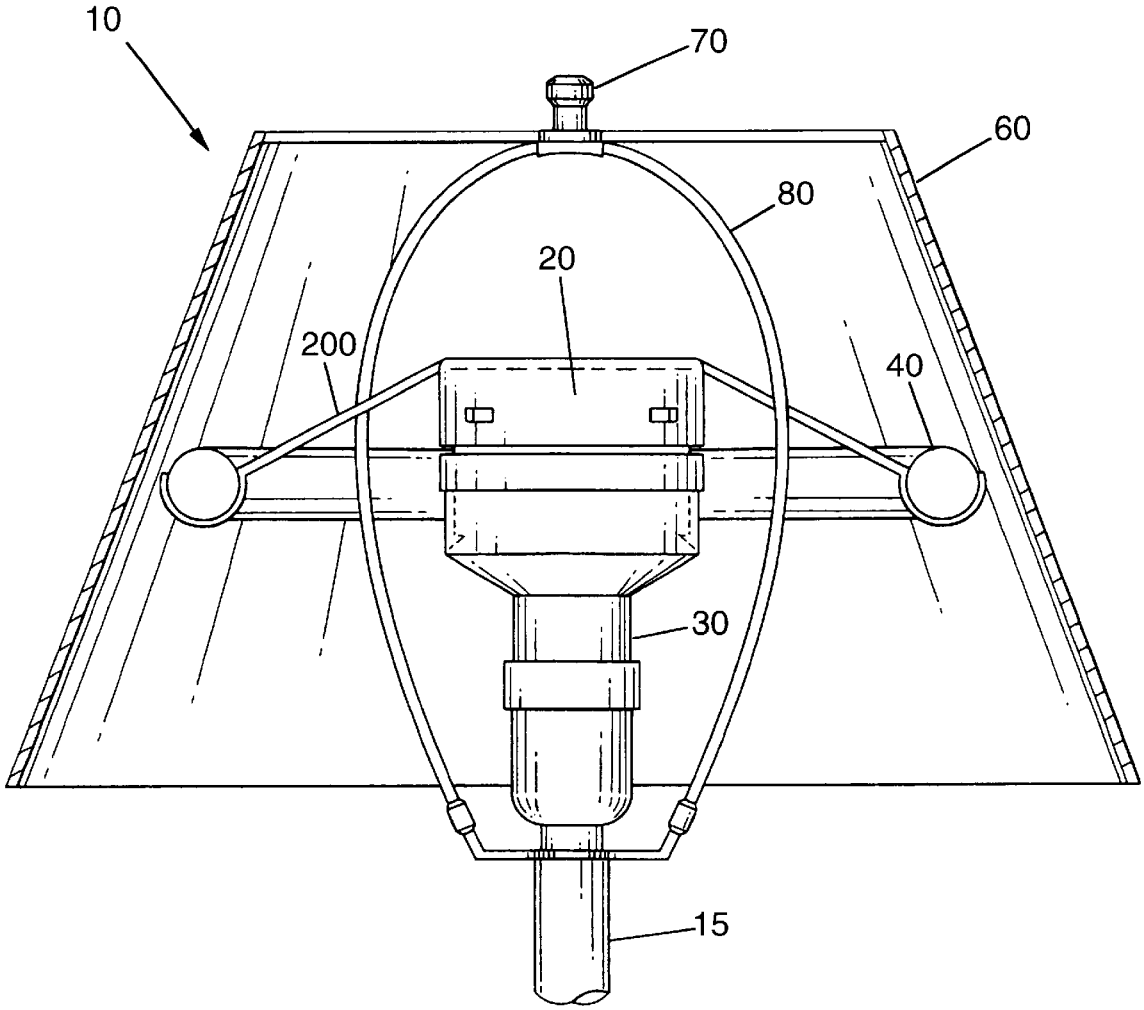
FIG. 1 is a side sectional view of a table lamp assembly using a circular fluorescent lamp operated by a replaceable electronic ballast that is plugged into the modular adapter receptacle.

Referring now to the drawings, the numeral 10 designates a typical table lamp having a modular replaceable plug-in electronic ballast 20 and a modular adapter 30 containing the ballast receptacle.

Figure 2:
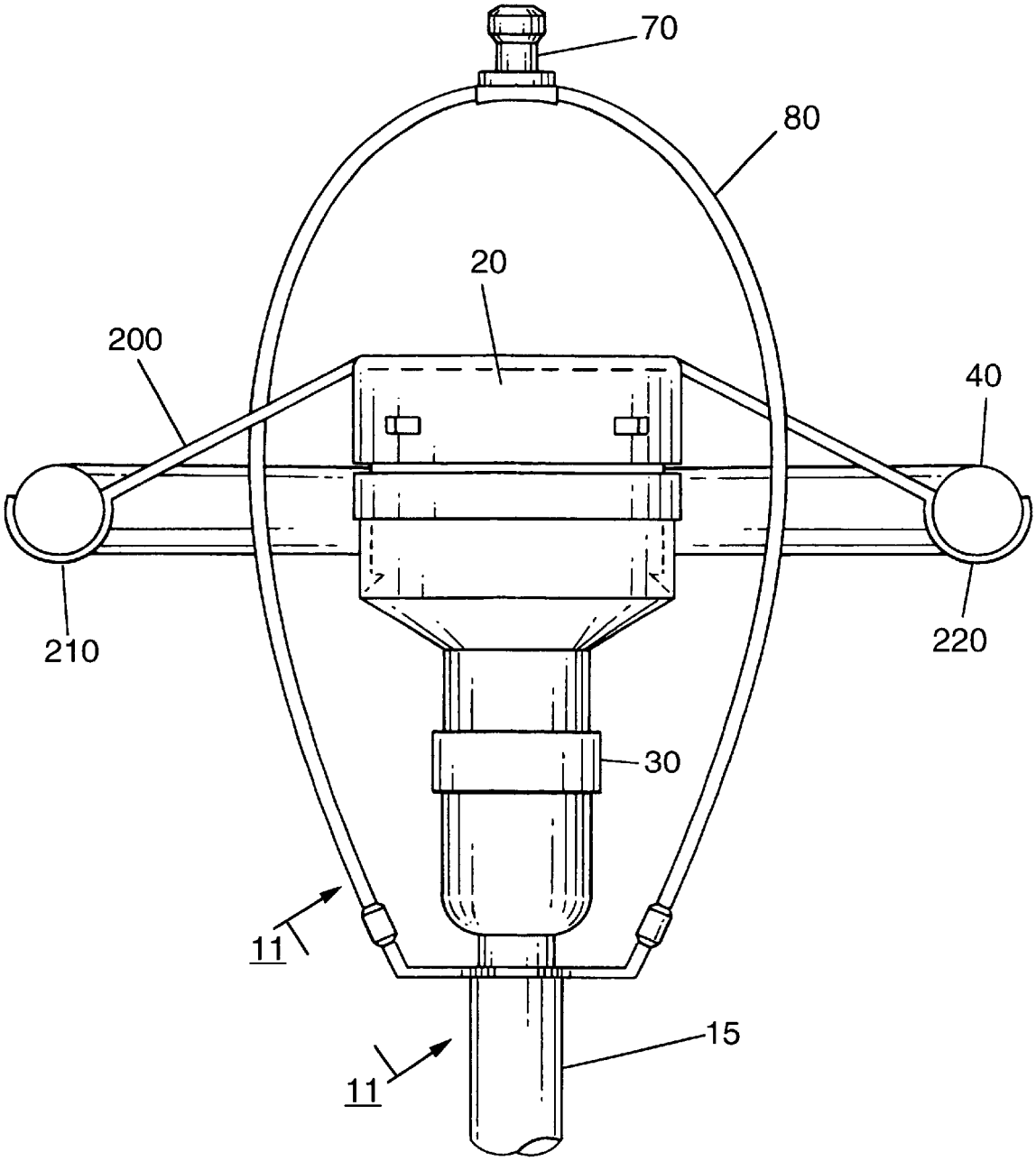
FIG. 2 is a detailed side sectional view of a table lamp assembly having a modular replaceable electronic ballast that is plugged into the modular adapter receptacle.

As shown in FIG. 1, and more particularly in FIG. 2, the table lamp assembly 10 is comprised of several basic components. They are: a lamp support column 15 to which is attached a lamp harp assembly 80, and a typical lampshade 60, setting atop the harp 80 and held in place by the finial 70.

The present invention relates to a modular replaceable plug-in electronic ballast 20 and a modular adapter 30 containing the ballast receptacle. While a circular fluorescent lamp 40 is shown, this plug-in electronic ballast can be used with fluorescent lamps of any shape. Secured to the top of lamp column 15 is the lower portion of the lamp harp 80. At the top of the lamp harp 80 is a 10–24 upright threaded portion which the supports the wire frame of the lampshade 60. A decorative finial 70, when screwed down, maintains the placement of the lamp shade in its desired position; thereby preventing the lamp shade from tipping unevenly to one side and also preventing it from rotating undesirably should one inadvertently brush against it.

Figure 3:
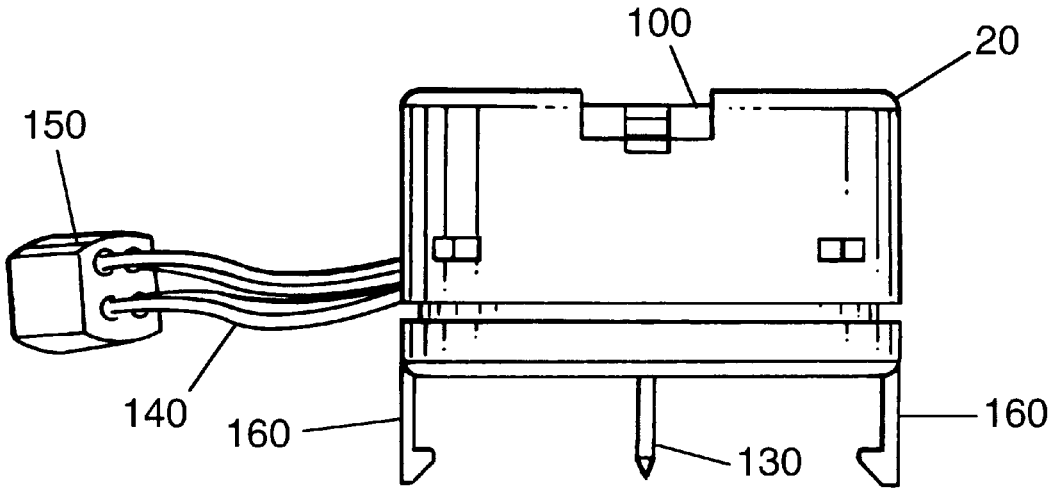
FIG. 3 is a side elevational view of the modular electronic ballast.
Figure 4:
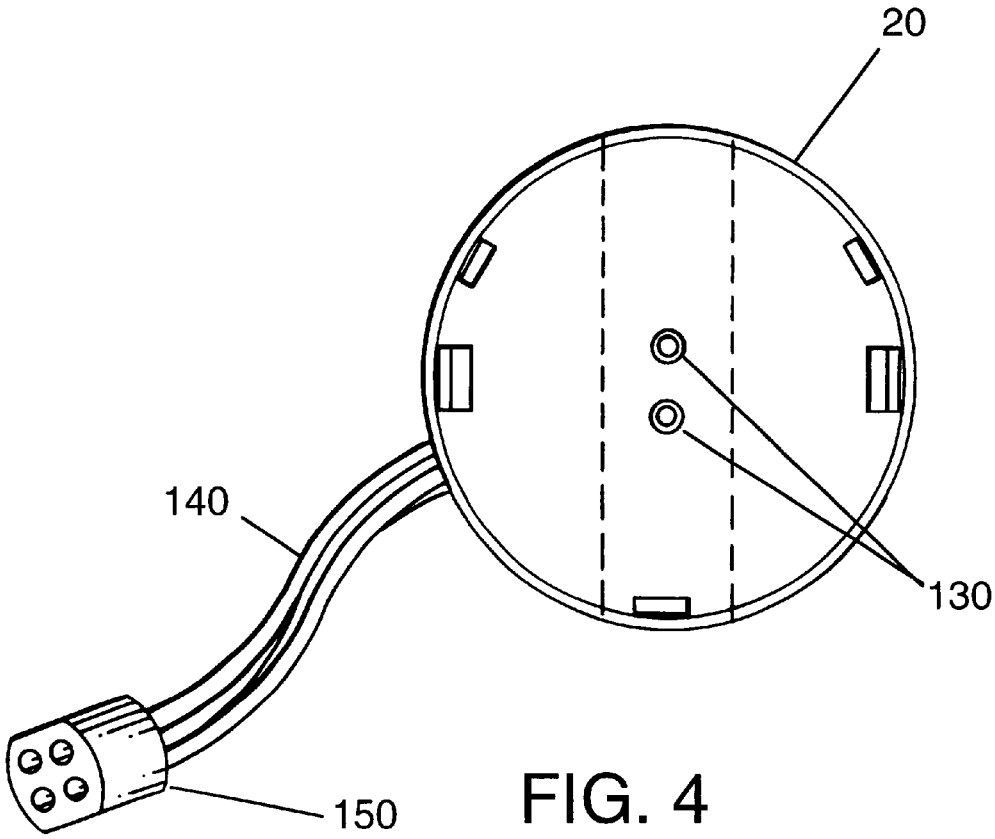
FIG. 4 is the bottom view of the modular electronic ballast.

Turning now to FIGS. 3 and 4, there is shown a side elevational and bottom view, respectively, of the replaceable modular plug-in electronic ballast 20. Molded to the lower side-wall are two diametrically opposed interlocking projections 160 that are inserted into the mating recesses 170 of the modular adapter; a plurality of depending tabs or projections 160 can be substituted for insertion into a plurality of mating recesses 170 of the adapter 30 to fasten the electronic ballast securely to the adapter.

As further shown, in FIGS. 3 and 4, the plug-in replaceable ballast 20 has two male input pins 130 that upon installation are inserted into the female receptacles 320. There is a rectangular slotted channel 100 on the upper surface of the ballast housing, designed to receive the lamp support bracket 200. The 4-wired connector 150, attached to the end of cable 140, connects to the fluorescent lamp pins 50 (not shown).

Figure 5:
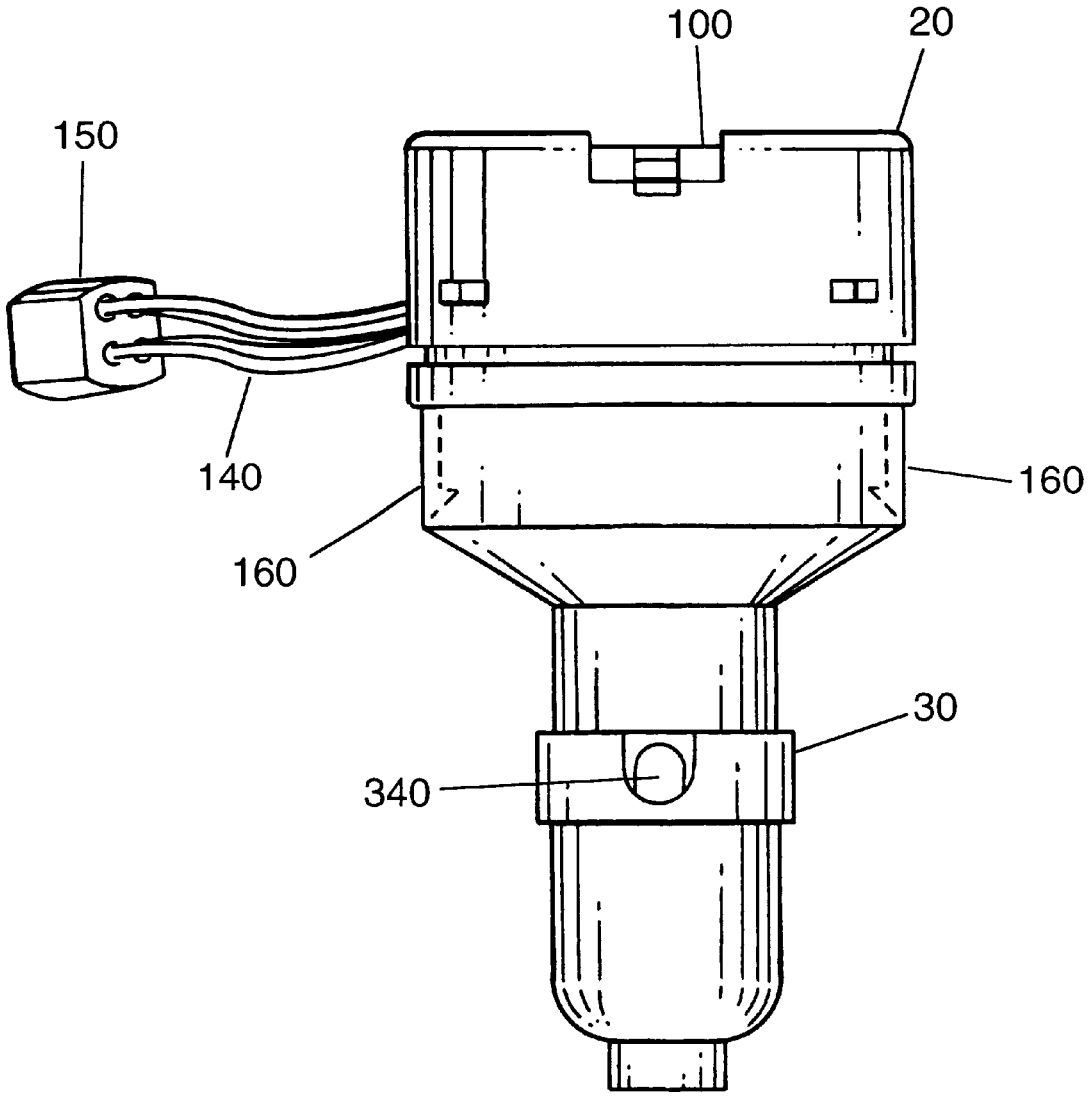
FIG. 5 is a side elevational view of the modular electronic ballast inserted into the modular adapter receptacle of the present invention.

FIG. 5 shows a side elevational view of the modular plug-in electronic ballast 20 that is inserted into the modular adapter ballast receptacle assembly 30. The ballast 20 is securely and firmly held in place by the two diametrically opposed interlocking projections 160 when engaged with the mating recesses 170 of the modular adapter.

The universal switch access hole 340 is provided to accommodate a rotary switch, (not shown), when used with a table lamp having a locally operated power switch. When a remotely operated switch is used, a blank switch plug 350 is inserted into the switch access hole 340 (as detailed in FIG. 8) to prevent injury from an electrical shock should a person or child insert a metallic object into the switch hole.

Figure 6:
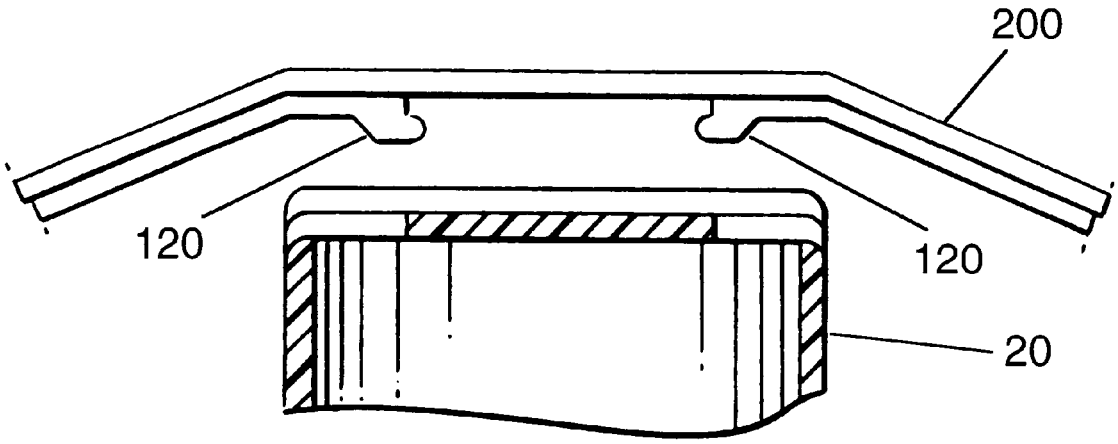
FIG. 6 is a fragmentary side sectional view illustrating the securement of the lamp support bracket to the ballast housing.
Figure 7:
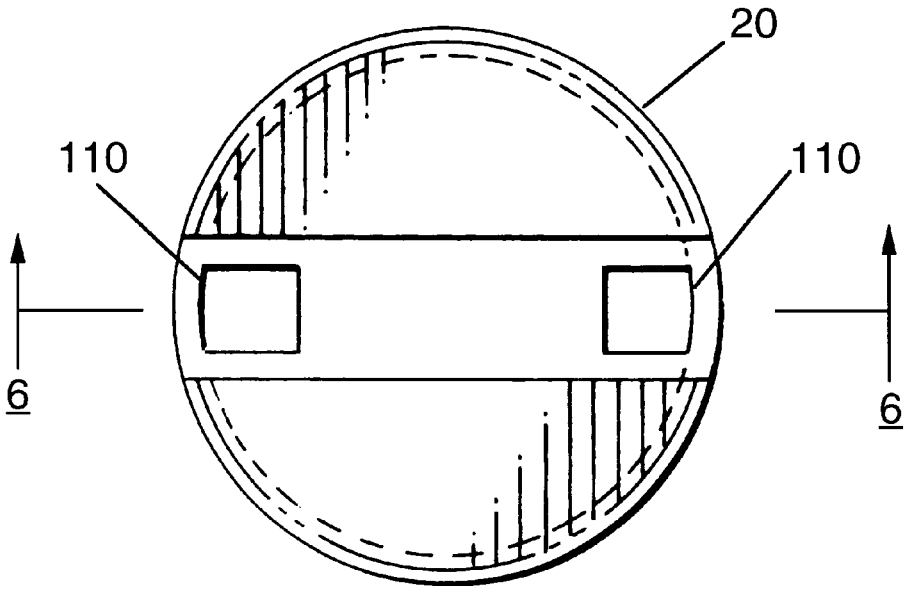
FIG. 7 is a fragmentary top view of the ballast housing detailing the rectangular holes that are used for attaching the lamp support bracket.

FIGS. 6 and 7 show the bat-winged lamp support bracket 200 mounted into slot 100. This rectangular slot 100 is found on the top surface of the ballast housing 20 where the bat-winged lamp support bracket 200 snaps into the inner surface of two square holes 110 where it is retained flush against the ballast by the two molded clips 120 positioned within a central area of the lamp support bracket 200, whereby the center of a circular fluorescent lamp is in alignment on a longitudinal axis of the table or floor lamp column. The lamp support bracket 200 may have a linear configuration, but the downward sloping bat-wing shape is preferable to minimize the spatial displacement required by the fluorescent lamp 40 retained in the bracket.

Figure 8:
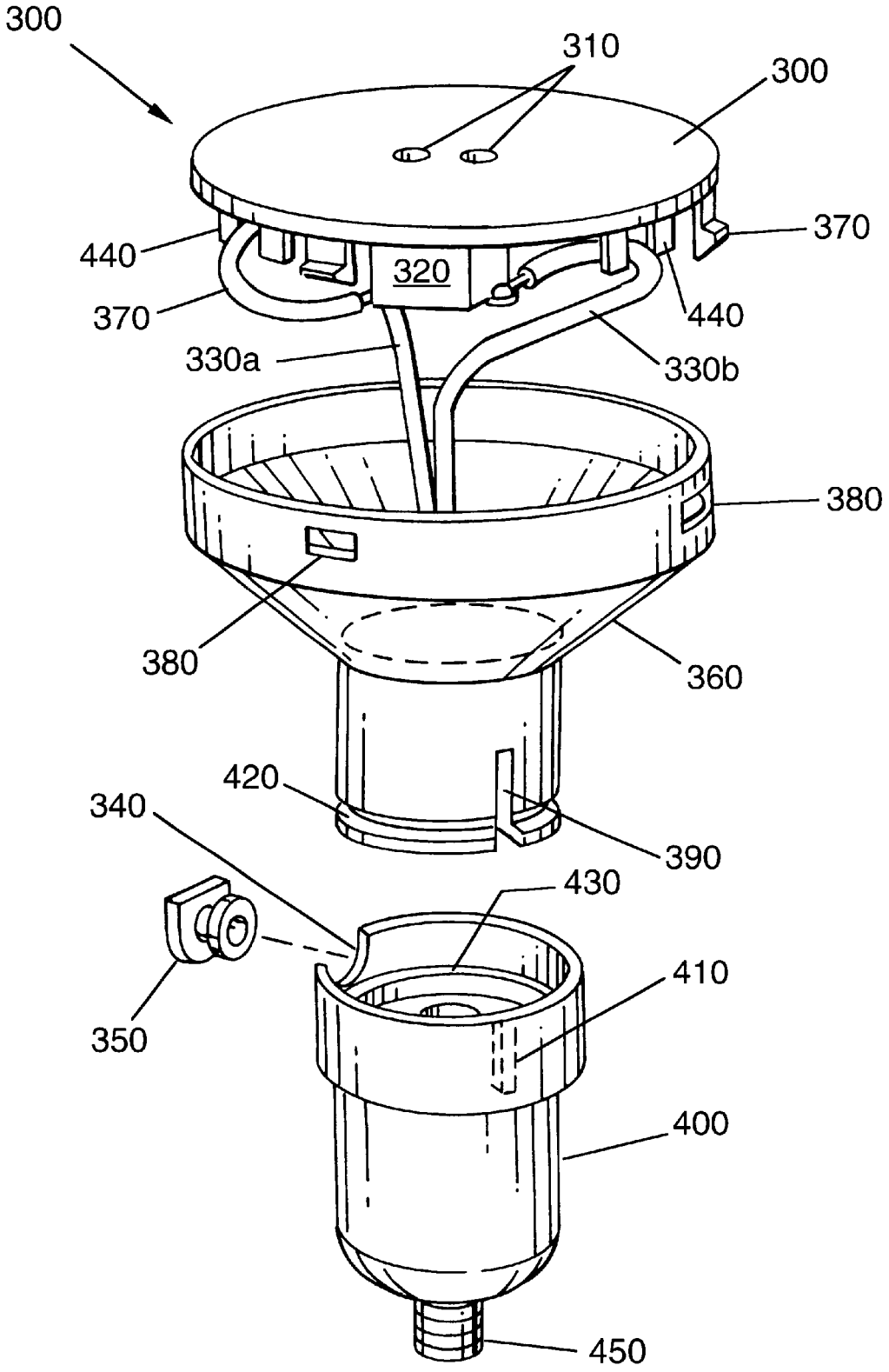
FIG. 8 is an exploded view of the modular adapter receptacle of the present invention.
Figure 9:
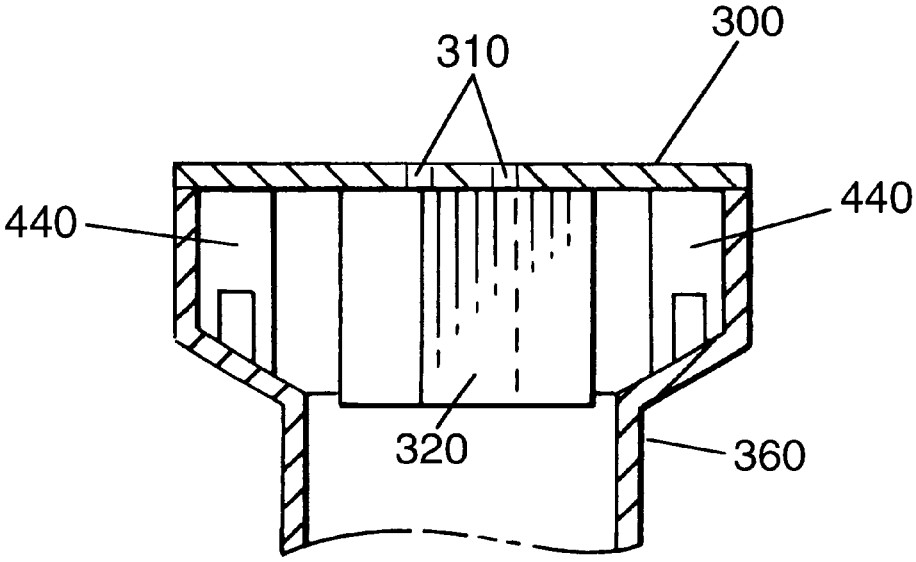
FIG. 9 is a fragmentary side sectional view of the adapter receptacle plate inserted into the adapter housing, illustrating the strain relief tines positioned relative to the adapter housing.
Figure 10:
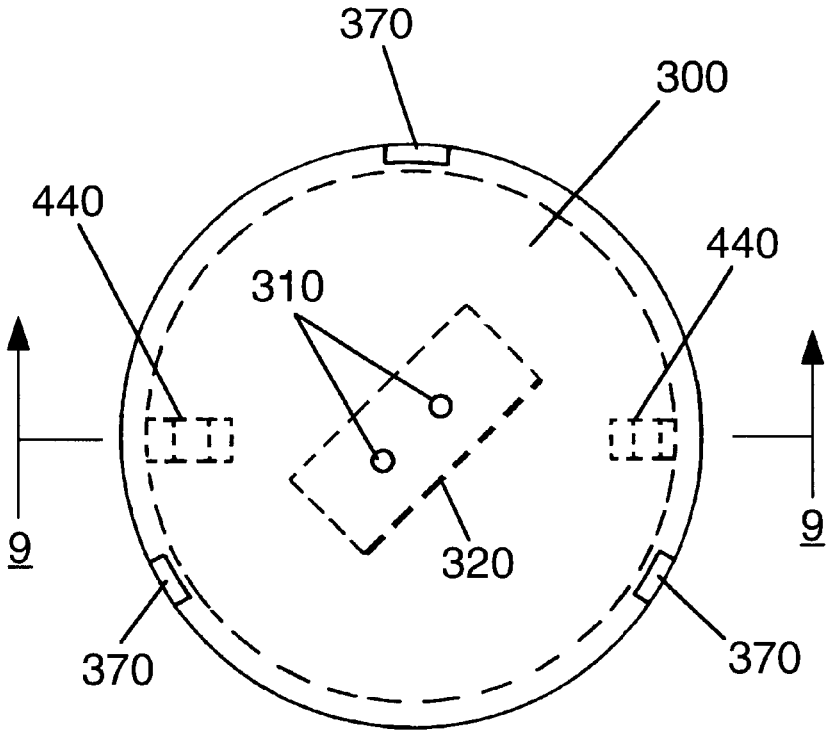
FIG. 10 is a top view of the adapter receptacle plate inserted into the adapter housing, illustrating the positioning of the strain relief tines.

Turning now to FIG. 8, there is shown an exploded view of the modular adapter assembly 30 detailing the nested interlocking components. FIGS. 9 and 10, taken in conjunction with FIG. 8, further show the details of the present invention.

At the top of the assembly is the circular receptacle plate or cover plate 300, having receptacle recesses 310 to receive and engage the two mating pins 130 of the replaceable electronic ballast 20.

Two pig-tailed lamp cord wires 330, one wire, color-coded with a white insulation 330*a*, designating the common connection, the other 330*b*, color-coded with any other dark color (except for green or white), connects to the female receptacle 320, in the ballast receptacle assembly 30. These wires are then available for subsequent connection to the lamp cord cable.

Alternatively, the lamp cord wires may be connected directly to the ballast receptacle, obviating the necessity for splicing or re-connecting to the lamp cord cable.

Molded integrally into the adapter receptacle plate 300 are two newly designed tines 440 that provide a unique strain relief system that captures and retains the lamp cord to prevent an electrical failure. These two sets of tines, each separate, captivate and secure each of the power lines of the lamp cord. The space between two of the tines is slightly smaller that the diameter of the insulated wire being inserted into this space. By inserting the insulated wire between the two tines, the insulation is slightly compressed, diametrically, thereby offering resistance when attempting to pull the wire longitudinally through the captivating tines.

The wires that are inserted between the tines are fully captivated and retained by inserting the adapter receptacle plate 300 into the adapter housing 360, which closes the gap between the tines 440, preventing the extraction of the inserted wires. This bridging action is best shown in the side sectional view of FIG. 9.

Extending beneath the periphery of the adapter receptacle cover plate 300 are three plastic tabs 370, equally spaced 120 degrees apart, that engage and interlock with the mating rectangular recesses 380 in the adapter housing 360. The key slot 390, extending longitudinally along the lower adapter housing 360, receives the rectangular key 410 found in the adapter base 400 to align the housing with the base.

At the bottom of the adapter housing 360 is an annular semicircular groove 420. This annular groove 420 is designed to receive the annular band 430 found in the inner sidewall of the adapter base 400.

A universal switch access hole 340 is provided to accommodate a rotary switch, (not shown), when used with a table lamp having a locally operated power switch. When a remotely operated switch is used, the blank switch plug 350 is inserted into the switch access hole 340 during the time of assembly. The blank switch plug 350 is used to prevent insertion of a metallic object into the switch hole, thereby preventing a person or child from receiving an electrical shock.

Two interchangeable bases are provided for use as the adapter base 400; the first having a male threaded ⅛ inch pipe nipple 450, the second having a boss with female ⅛ inch pipe threaded opening (not shown).

Procedure for Replacing the Electronic Ballast

1. Remove all power to the lamp by unplugging the lamp cord from the wall outlet to eliminate a shock hazard.
2. Remove the finial 70 by rotating in a counterclockwise direction.
3. Remove the lampshade 60.
4. Disconnect the 4-wire ballast cable 140 by unplugging the 4-wire connector 150 from the fluorescent lamp pins 50.
5. Remove the fluorescent lamp 40 from the first lamp cradle 210 and the second lamp cradle 220, as shown in FIG. 2, and set to one side.

Figure 11:
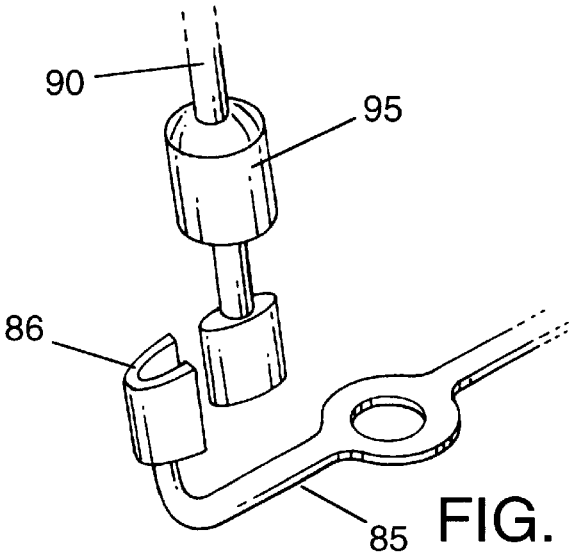
FIG. 11 is a detailed fragmentary perspective view of the harp engagement means.

Referring now to FIG. 11, there is shown in detail the harp disengaging means for the removal of the electronic ballast 20, should a replacement become necessary.

6. Slidably raise the lower harp ferules 95 upwardly. Then grasp the lower ends of the harp 90 and gently compress them together by squeezing toward each other, to disengage the ends of the harp from the engaging ends of the harp base 86.
7. Remove the lamp support bracket 200 by unsnapping from the slot 100 found in the upper surface of the ballast housing 20.

Figure 12:
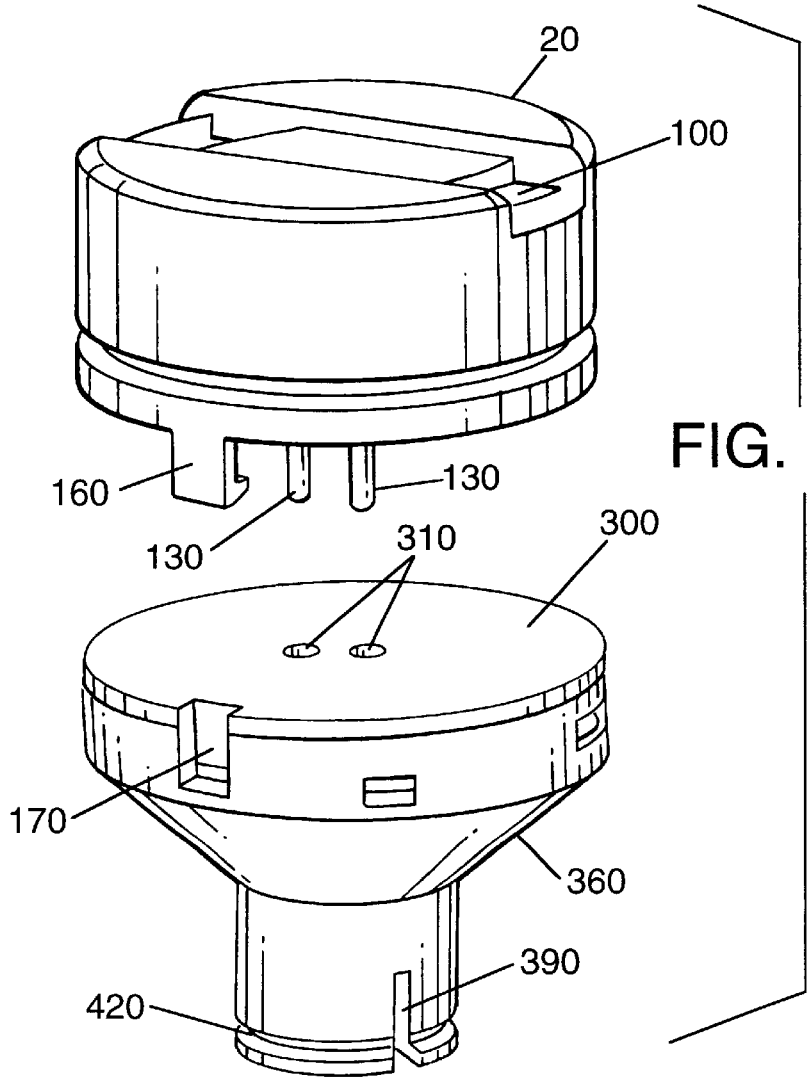
FIG. 12 is a detailed fragmentary perspective view of the replaceable electronic ballast engagement with the modular adapter.

FIG. 12 illustrates the replacement and removal of the replaceable ballast 20 into the adapter receptacle 30.

8. Place a small flat blade screwdriver or nail file under one of the interlocking projections 160 and pry gently upward to disengage it from the mating recess 170.
9. Remove and replace the ballast 20.
10. Install the replacement ballast and reassemble the table lamp in the reverse sequence.

While the various aspects of the invention have been described with reference to the specific exemplary structure and method of use, it should be understood that numerous alterations, modifications, advances or changes will become apparent to those skilled in the art in light of this disclosure. Accordingly, it is intended to embrace such alterations, modifications, advances, changes and equivalents which fall within the scope and spirit of this invention as defined by the following claims.

What is claimed is:

1. A table lamp including a lamp column with a harp mounted on the column for supporting a lamp shade, the table lamp comprising:

a lamp assembly including a fluorescent lamp having four lamp pins and communicating with an electronic ballast through a ballast connector, the ballast having two centrally located pins insertable into two female receptacles of a modular adapter, the ballast situated in-line above, and secured to, the modular adapter that is mounted on the column, said electronic ballast and the modular adapter positioned within the lamp shade support harp, the fluorescent lamp in alignment with a longitudinal axis of the lamp column and communicating with a power source through said pins, a ballast connector and a lamp cord;

means within the adapter for strain relief of the lamp cord to capture and retain the lamp cord for preventing an electrical failure; and, means for replacing the ballast without rewiring the table lamp by unplugging the ballast from the fluorescent lamp and from the adapter.

2. The table lamp according to claim 1, further comprising a means for locking the modular ballast to the adapter.

3. The table lamp according to claim 2, further comprising a means for mounting the ballast adapter on the column.

4. The table lamp according to claim 3, the ballast having first and second ends with two mating pins extending from the first end and a ballast cable with a 4-wire connector emanating from the ballast for connection to the lamp.

5. The table lamp of claim 4, the fluorescent lamp having four connector pins for connection with the ballast 4-wire ballast connector.

6. The table lamp according to claim 5, the adapter comprising an adapter receptacle assembly including an adapter housing removably secured to an adapter base, and a cover plate removably interlocked to the housing, the cover plate including said two receptacle recesses to receive the ballast mating pins, whereby the ballast can be unplugged from the adapter and the lamp for removal and replacement of a defective ballast without rewiring.

7. The table lamp of claim 6, the ballast second end including a slotted channel to receive a lamp support bracket flush against the ballast.

8. The table lamp of claim 7, the lamp support bracket having a central area and including a pair of clips within the central area engaged in mating holes located on the ballast second end, whereby a center of the fluorescent lamp is on a longitudinal axis of the column.

9. The table lamp according to claim 8, the lamp cord comprising two insulated wires, each having a diameter; the means for resisting strain on the lamp cord comprising two pair of spaced apart tines, wherein a space between the tines of each pair is smaller than the diameter of an insulated wire insertable therein, whereby each of the wires is diametrically compressed by a pair of tines to captivate and secure the lamp cord wires for resistance against a longitudinal pull or strain on the lamp cord.

10. The table lamp of claim 9, wherein the cover plate includes a plurality of downward extending tabs; and a corresponding plurality of mating recesses are positioned in the housing to receive the each of the tabs in a respective recess to removably interlock the cover plate on the housing.

11. The table lamp according to claim 10, the adapter housing having a key slot extending longitudinally along a lower portion thereof that receives a rectangular key in the adapter base, whereby the housing is aligned with the base.

12. The table lamp of claim 11, the adapter housing including an annular semicircular groove that receives an annular band in an inner sidewall of the adapter base, whereby the housing is removably secured to the base.

13. The table lamp of claim 12, wherein the adapter base is threaded and the column includes a correspondingly threaded top portion, whereby the adapter is threadably mounted on the column.

14. The table lamp of claim 13, wherein the lamp support bracket has a bat-wing shape with arms extending radially down and away from the ballast second end to minimize a displacement of the fluorescent lamp retained by the bracket.

15. The table lamp of claim 14, the adapter housing further comprising a switch access hole to receive a rotary power switch for use in a table lamp having a locally operated switch.

16. The table lamp of claim 14, the adapter housing further comprising a blank switch plug insertable into a switch access hole of the housing for use with a remotely operated power switch to prevent injury from an electrical shock.

17. In a table or a floor lamp with a lamp column, a harp mounted on the column for supporting a lamp shade, and a lamp assembly including an electronic ballast connected to a fluorescent lamp positioned above the column, the fluorescent lamp having four pins insertable into a ballast connector, an improvement comprising a modular adapter mounted on the column and having two receptacles wired to a power source to receive two ballast mating pins insertable therein, the electronic ballast secured to the modular adapter by two locking tabs engaged in compatible recesses of the adapter, said ballast and adapter both disposed within said harp, whereby the ballast can be unplugged from the fluorescent lamp and from the adapter for removal and replacement of a defective ballast without rewiring; and, further comprising a pair of tines within the modular adapter near each of the receptacles, to capture a receptacle wire and resist any strain or pull away from the receptacles.

* * * * *